US005264036A

United States Patent [19]

Haas et al.

[11] Patent Number: 5,264,036

[45] Date of Patent: Nov. 23, 1993

[54] APPARATUS FOR APPLYING A FLUID UNDER HYDROSTATIC PRESSURE TO A MOVING WEB OF MATERIAL

[75] Inventors: Raimund Haas, Frankfurt; Peter Lehmann, Kelkheim; Hans Heist, Wiesbaden, all of Fed. Rep. of Germany

[73] Assignee: Hoechst Aktiengesellschaft, Frankfurt am Main, Fed. Rep. of Germany

[21] Appl. No.: 970,221

[22] Filed: Nov. 2, 1992

Related U.S. Application Data

[63] Continuation of Ser. No. 636,255, Dec. 31, 1990, abandoned.

[30] Foreign Application Priority Data

Jan. 9, 1990 [DE] Fed. Rep. of Germany ..... 4000405

[51] Int. Cl.[5] ..... B05C 5/02

[52] U.S. Cl. ..... 118/315; 118/412; 118/415; 134/122 R; 239/451; 239/553.5; 239/566

[58] Field of Search ..... 118/315, 410, 411, 412, 118/415; 427/420; 239/451, 553, 562, 553.5, 566, 569; 134/122 R; 68/205 R

[56] References Cited

U.S. PATENT DOCUMENTS

| | | | |
|---|---|---|---|
| 2,733,171 | 1/1956 | Ransburg | 118/315 |
| 3,237,872 | 3/1966 | Mincy | 239/566 X |
| 3,431,899 | 3/1969 | Fraatz | 118/315 |
| 3,526,535 | 9/1970 | Plumat | 117/120 |
| 4,550,681 | 11/1985 | Zimmer et al. | 118/840 |
| 4,656,063 | 4/1987 | Long et al. | 427/420 |
| 4,747,541 | 5/1988 | Morine et al. | 239/562 X |
| 4,748,043 | 5/1988 | Seaver et al. | 118/630 X |
| 4,846,099 | 7/1989 | Krippl et al. | 118/323 |

FOREIGN PATENT DOCUMENTS

| | | |
|---|---|---|
| 279323 | 8/1988 | European Pat. Off. . |
| 3622798 | 12/1987 | Fed. Rep. of Germany . |

*Primary Examiner*—Terry J. Owens
*Attorney, Agent, or Firm*—Foley & Lardner

[57] ABSTRACT

An apparatus for applying a fluid to a moving carrier strip includes a distributor and a plurality of individual flow channels which together form a multi-jet nozzle. The individual flow channels in the form of capillary tubes are arranged at right angles to the distributor axis at equal distances along a longitudinal line parallel to the distributor axis. The capillary tubes protrude into an internal chamber of the distributor and the capillary tube located at each end of the longitudinal line protrudes further into the interior of the distributor than the other capillary tubes.

21 Claims, 8 Drawing Sheets

APPARATUS FOR APPLYING A FLUID UNDER HYDROSTATIC PRESSURE TO A MOVING WEB OF MATERIAL

This application is a continuation of application Ser. No. 07/636,255, filed Dec. 31, 1990, now abandoned.

BACKGROUND OF THE INVENTION

The present invention relates to a process for applying a fluid to a moving web of material and to apparatus for performing this process, having a distributor for the fluid.

The fluid can be a liquid or a gas. In particular, in addition to homogeneous coatings, the process allows uniform wetting or rinsing of rapidly moving webs of material by means of liquids of any kind, such as, for example, water, acid, alkalis or solutions whose ingredients are caused to interact with the surface of the web of material. The web of material is in general a carrier strip, for example, an aluminum strip.

The use of the present process is particularly advantageous in the production and further processing of offset printing plates. For example, the aluminum carrier material for the production of offset printing plates, after degreasing which is carried out with a pickling liquor, is rinsed very uniformly with water in order to avoid pickling spots. Moreover, the carrier material is rinsed in further process steps with surface-active solutions, surface-active ingredients being applied to the surface of the web of material via the wetting of the carrier material. Furthermore, the pretreated carrier material is coated with light-sensitive substances, which are applied in the form of a solvent-containing wet film to the carrier surface, and the solvents are then evaporated, so that the light-sensitive substances alone remain. Uniform wetting is also important in the development of exposed offset printing plates, which are contacted with developer solution in development apparatuses.

Rinsing and/or wetting steps can be carried out in various ways, for example, by means of spray bars which are arranged transversely to the web of material and are equipped with specially designed spray nozzles for distributing the rinsing liquid. The number and shape of the spray nozzles per unit width depends here on the magnitude of the spray volume stream to be applied, the spray liquid being atomized by the nozzle pressure for fine distribution and/or being fanned out across the width of the web of material by a special design of the nozzles. This method is intended to achieve simultaneously continuous wetting of the web of material across the width and a rinsing action.

A disadvantage of spray bars is that, during the atomization, undesirable aerosols are formed, particularly when acid- or alkali-treated webs are rinsed. Furthermore, it is a disadvantage of spray bars that the desired uniform distribution across the width of the web of material can be achieved only within a narrowly limited volume stream range for the rinsing liquid. Uniform rinsing is therefore frequently not ensured in the case of variable speeds of the web of material. In addition, the superposition of the spray cones of the adjacent nozzles leads to undesired fluctuations in the thickness of the liquid film applied, which fluctuations can cause non-uniform chemical reactions.

In coating technology, processes are applied in which slot dies or film coaters produce a liquid film via a short liquid bridge or a free-falling curtain which coats and/or wets the moving web of material without contact. In the case of liquids with low film thickness or with high surface tensions, however, the film curtain frequently tends to have flow instabilities and tears due to constriction and drop formation across the width. The undesirable consequence thereof is unwetted areas on the moving web of material.

SUMMARY OF THE INVENTION

It is therefore an object of the present invention to provide a process and apparatus for uniform application of a fluid, in particular a liquid, to a moving web of material, which ensures splash-free coating, wetting or rinsing of the surface of the web of material, by avoiding formation of aerosols.

In accomplishing the foregoing objects, there is provided according to the present invention a process for applying a fluid to a moving web of material comprising applying a plurality of discrete individual fluid streams to the moving web along a line transverse to the running direction of the moving web, the individual streams, upon striking the moving web, each coating a predetermined web width, wherein the distance between the individual streams is selected such that fluid bridges form on the moving web between the individual coated web widths to produce a fluid film covering substantially the entire coating width of the moving web and having a substantially uniform thickness.

There also is provided according to the present invention a process for applying a fluid to a moving web of material, comprising the steps of: (a) introducing the fluid into a distributor positioned above the moving web; (b) passing the fluid from the distributor into a plurality of individual flow channels to form individual fluid streams, each flow channel having an outflow orifice; (c) depositing the individual fluid streams onto the moving web, the individual streams each coating a predetermined web width; and (d) forming fluid bridges on the moving web between the individual coated web widths.

Preferably the frictional pressure drop in the fluid flowing along the distributor is smaller than the frictional pressure drop in the individual fluid streams flowing along the individual flow channels. Moreover, the frictional pressure drop along the individual flow channels preferably is greater than the maximum hydrostatic differential pressure established between the fluid in the distributor and the fluid cross-sections at the outflow orifices of the individual flow channels.

According to the present invention, there is provided further an apparatus for applying a fluid to a moving web of material, comprising a distributor for the fluid positioned above the moving web and a plurality of individual flow channels contiguous to the distributor, wherein the individual flow channels are arranged at right angles to the distributor axis at equal distances along a longitudinal line parallel to the distributor axis.

According to a first embodiment of the present apparatus, the individual flow channel comprises a capillary tube which is inserted into a bore formed in the wall of the distributor along the above-mentioned longitudinal line. In a second embodiment, there is included a slot die which is connected to the distributor via an elongated rectangular channel, wherein the individual flow channel comprises a capillary tube projected into the channel through a perforated outflow strip which seals the underside of the slot die. In a third embodiment, there is included a square-shaped outflow body of solid material adjoining a side wall of the distributor, wherein the individual flow channels comprise mutually parallel perforations formed in the outflow body. In a fourth embodiment, the individual flow channels comprise a plurality of parallel bores formed in the wall of the distributor arranged along a longitudinal line. In a fifth embodiment, there is included a pair of mobile pistons as the end faces of the distributor and means for adjusting laterally the positions of the pistons within the tubular distributor. In a sixth embodiment, the distributor comprises a first half which has a smooth boundary surface, a second half which has a boundary surface provided with fluted grooves which form the individual flow channels, and means for joining together said first and second halves.

Further objects, features and advantages of the present invention will become apparent from the detailed description of preferred embodiments that follows.

BRIEF DESCRIPTION OF THE DRAWINGS

The present invention is explained in more detail below by reference to illustrative examples represented in drawings in which.

DETAILED DESCRIPTION OF THE PREFERRED EMBODIMENTS

Figure 1:
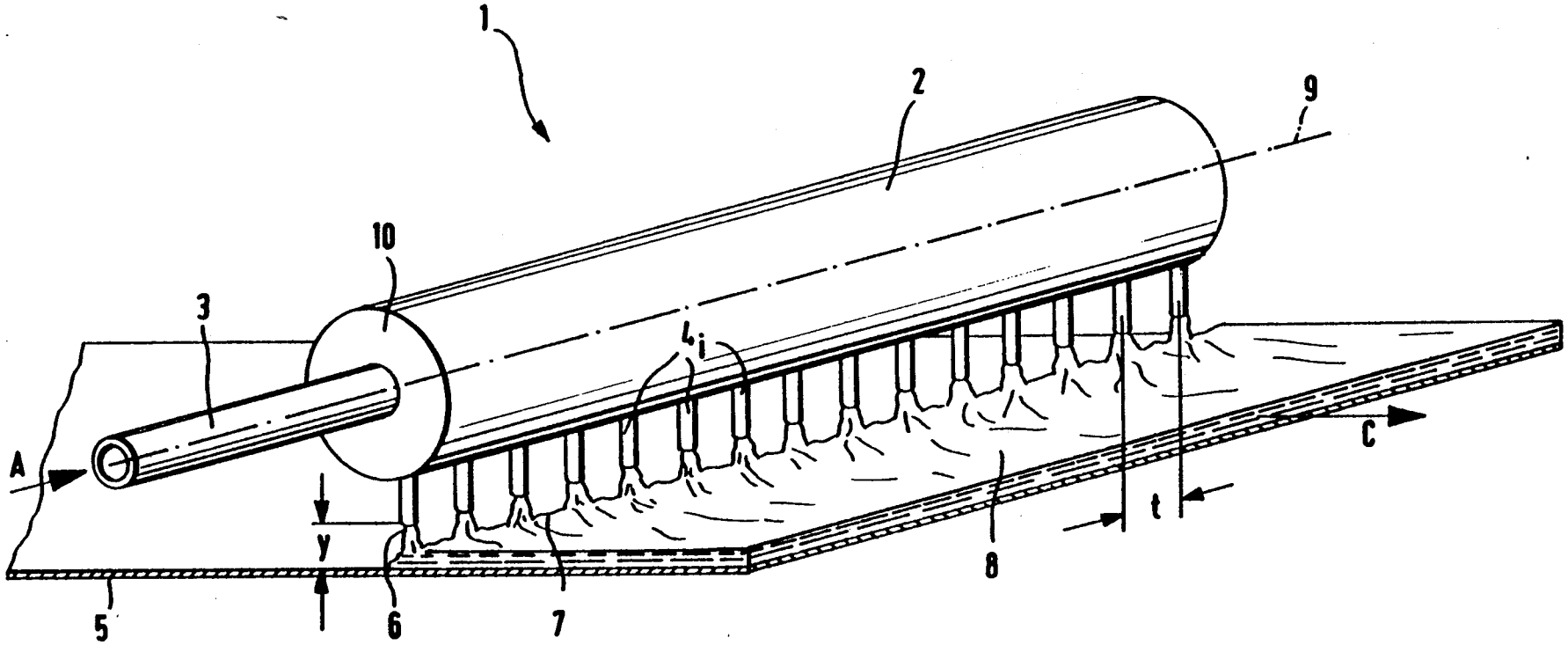
FIG. 1 shows a perspective view of a first embodiment of a multi-jet nozzle consisting of a tubular distributor with inserted capillary tubes, according to the present invention.

According to the present process, the fluid stream to be applied to the moving web of material is passed transversely to the running direction of the web of material by means of the distributor and divided into a multiplicity of individual fluid streams which flow side-by-side onto the web of material and which, upon striking the web of material, each wet a predetermined web width, the distance between the individual volume streams being selected such that fluid bridges, which converge to give a uniformly thick fluid film which covers the entire coating width of the web of material, form between the coated web widths.

In a further development of the present process, the frictional pressure drop of the fluid flowing transversely to the running direction of the web of material is selected such that it is substantially smaller than the frictional pressure drop in the individual fluid streams. Advantageously, the frictional pressure drop along the individual fluid streams is greater than the maximum hydrostatic differential pressure established between the fluid flowing transversely to the running direction and an outflow cross-section of the individual fluid streams.

In an embodiment of the present process, the individual fluid streams are adjusted to turbulent flow conditions which, on striking the moving web of material, lead to rinsing in addition to uniform coverage with the fluid.

In the process according to the present invention, the fluid is introduced into a distributor arranged transversely to the running direction of the web of material and forced fine distribution of the individual fluid streams is then obtained by means of a multiplicity of individual flow channels arranged along the distributor axis. The total fluid stream is divided over the width of the web of material into a multiplicity of individual fluid streams which each supply a defined web width with fluid.

According to the present invention, an apparatus for applying a fluid to a moving web of material includes a multi-jet nozzle comprising a distributor and a plurality of individual flow channels, wherein the individual flow channels are arranged in equal mutual distances along a longitudinal line or a slot parallel to the distributor axis and at right angles to the distributor axis.

In one embodiment, the individual flow channels comprise capillary tubes of a length 1, an internal diameter $D_i$ of about 0.2 to 3.0 mm and an external diameter $D_a$ of about 1.0 to 5.0 mm, wherein the capillary tubes are inserted into bores in the distributor wall along the longitudinal line via a snap fit or solder.

In a further embodiment of the present apparatus, the multi-jet nozzle comprises a tubular distributor and a slot die which is connected to the distributor via an elongated rectangular channel, wherein the individual flow channels in the form of capillary tubes protrude into the channel of the slot die through a perforated outflow strip which seals the underside of the slot die.

In another embodiment, the multi-jet nozzle comprises a hollow, cubic distributor and a square-shaped outflow body of solid material with mutually parallel perforations as individual flow channels, wherein the outflow body adjoins a side wall of the distributor, the side wall having wall bores flush with the individual flow channels.

The multi-jet nozzle can also consist of only a tubular distributor in whose outer surface individual flow channels in the form of mutually parallel bores are arranged as a row of holes along a longitudinal line.

In an additional embodiment, the multi-jet nozzle comprises a hollow, tubular distributor having mobile pistons as the end faces, the pistons carrying, in circumferential annular grooves, sealing rings which are in sealing contact with the inner wall of the distributor, and furthermore the pistons being laterally adjustable in the distributor by means of spindles.

In a further embodiment, the multi-jet nozzle comprises a two-part distributor, the two halves of the distributor are held together by a screwed joint and one half has a smooth boundary surface, whereas the other half possesses a boundary surface provided with fluted grooves which form individual flow channels for the individual fluid streams.

If turbulent flow conditions are established in the individual flow channels, the individual liquid jets striking the moving surface of the web of material additionally achieve a rinsing action in that region.

If a very small distance between the web of material and the outflow orifice of the individual flow channels and laminar flow conditions in the individual flow channels are established, a closed laminar film curtain can be obtained immediately since, due to the effect of the surface tension of the liquid, the liquid jets form bridges between the channels immediately after emerging from adjacent individual flow channels.

The simplest design of an individual flow channel represents a capillary tube of circular cross-section. However, any other cross-section can also be chosen, it being advantageous, when setting a laminar channel flow, when the tubes form, with their outflow orifices, a comb-like configuration and the tubes protrude from the distributor tube by a defined length. This ensures that the individual stream flows in the form of free-falling liquid jets that do not partially contract even in the case of relatively large distances of the multi-jet nozzle from the web of material and cause a flow instability. To obtain a turbulent outflow, however, a drilled row of holes in the shell material of the distributor or an additional perforated outflow strip can be used as the arrangement for individual flow channels, in which case the perforations in the walls of the distributor or in the outflow strip must have a sufficient length.

With the present invention, the advantage is achieved that, particularly in the case of large safety distances between the application equipment and the moving web of material, the liquid can be applied very uniformly and free of aerosols. If laminar flow conditions are established in the individual flow channels, the individual volume streams or the liquid outlet jets can be applied completely without splashes to the moving web of material, the liquid jets converging on the moving web of material and forming a closed liquid film as a result of a suitable choice of the channel division across the width. This step corresponds to uniform wetting or homogeneous coating of the surface of the moving web of material.

A further advantage of the present invention results from the fact that, due to the selection of a defined distribution of the length of the individual flow channels over the width of the web of material, a variable outlet velocity and thus also variable, but predetermined film thicknesses or a defined rinsing action can be achieved.

FIG. 1 diagrammatically shows, in a perspective view, a multi-jet nozzle 1 having a tubular distributor 2 which is supplied, via an inlet branch 3, with liquid which flows in the direction of the arrow A. The tubular distributor 2 has an internal chamber 39, shown in FIG. 2, into which the liquid flows. The horizontal inlet branch 3 is, for example, aligned with the distributor axis 9 and is fitted to one of the end faces 10 of the distributor 2. Of course, the inlet branch can also be aligned perpendicular to the distributor axis 9 and can extend in the middle at a right angle to a longitudinal line of the circumferential distributor surface or can be arranged at another point along the longitudinal line.

Individual flow channels $4_i$ for the liquid are defined by capillary tubes, which are inserted into the circumferential surface of the distributor 2 and are arranged along a longitudinal line of the distributor 2. The liquid flows vertically downwards through the individual flow channels $4_i$ by flow deflection and onto a carrier strip 5 moving past horizontally in the direction of the arrow C at a distance y from the outlet orifices or the outlet cross-sections of the individual flow channels. From the outlet orifices of the individual flow channels $4_i$, the individual liquid streams or liquid jets 6 flow onto the surface of the carrier strip 5. As the individual liquid streams 6 strike the moving web of material, liquid bridges 7 form between the liquid streams 6 and produce a closed liquid film 8 on the carrier strip 5.

The frictional pressure drop of the fluid or liquid flow along the distributor is substantially smaller than the frictional pressure drop of the individual flow streams 6 along the individual flow channels $4_i$. In addition, the frictional pressure drop along the individual flow channels is greater than the maximum hydrostatic differential pressure established between the chamber of the distributor and the individual outflow orifices or outflow cross-sections of the individual flow channels. As a result, there is uniform flow in the individual fluid streams and self-filling of the distributor chamber.

Figure 2:
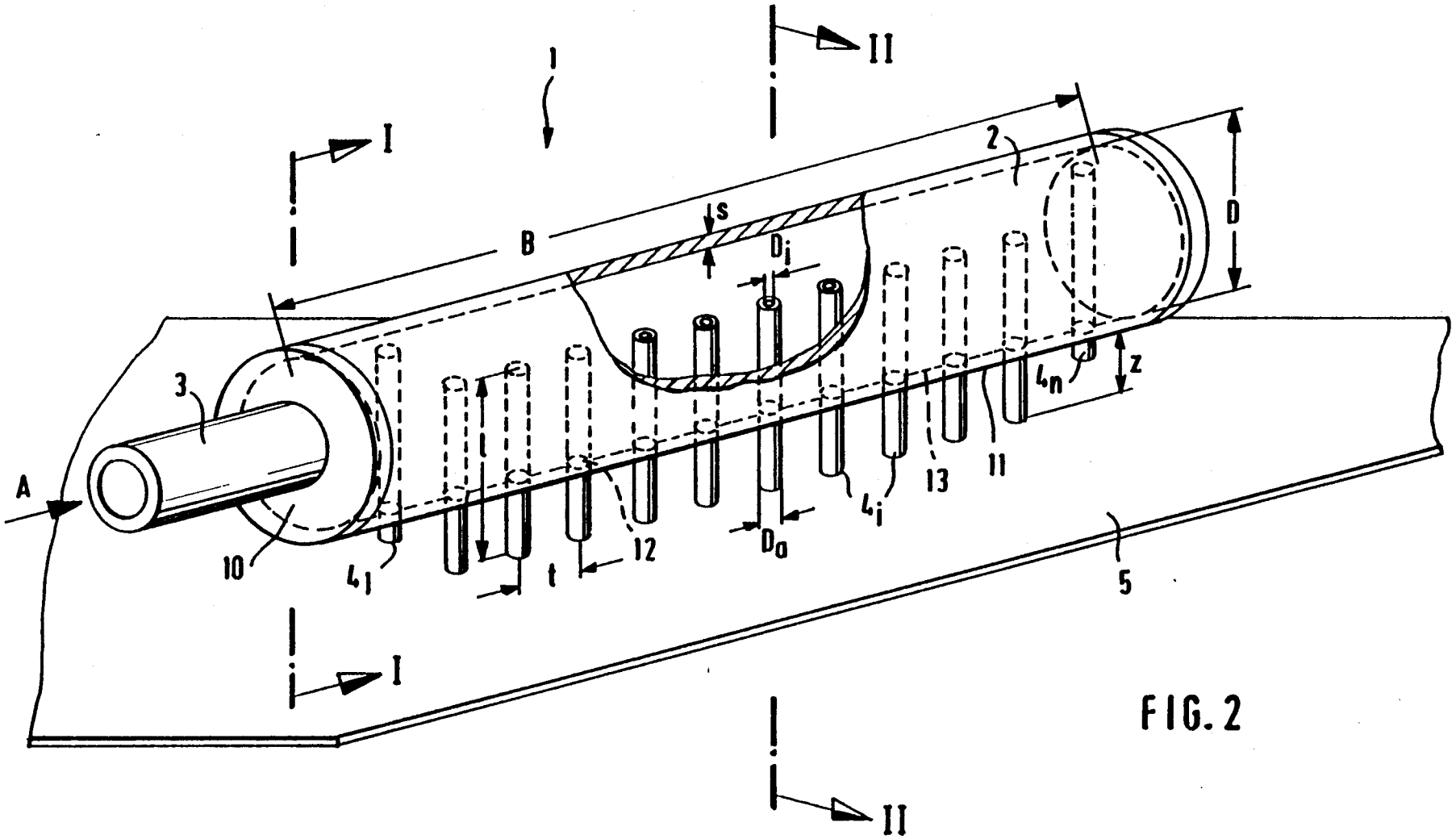
FIG. 2 shows a perspective view, partially broken open, of the first embodiment of the multi-jet nozzle with a circular-symmetrical, tubular distributor and capillary tubes inserted therein.

FIG. 2 shows a perspective view, partially broken open, of the multi-jet nozzle 1 according to FIG. 1. The internal chamber 39 of the tubular distributor 2 has a diameter D and a width B. The individual flow channels $4_i$ or capillary tubes protruding into the interior of the tubular distributor 2 have a length 1 and protrude from the circumferential surface 11 of the distributor by a distance z. The circumferential surface 11 of the distributor 2 is perforated along a longitudinal line 13, drawn in dashes, at a pitch t, and the capillary tubes having an external diameter $D_a$ of about 1.0 to 5.0 mm and an internal diameter $D_i$ of about 0.2 to 3.0 mm are snap fit, soldered or stuck into bores 12, thus formed, of the distributor having a wall thickness s.

Figure 3:
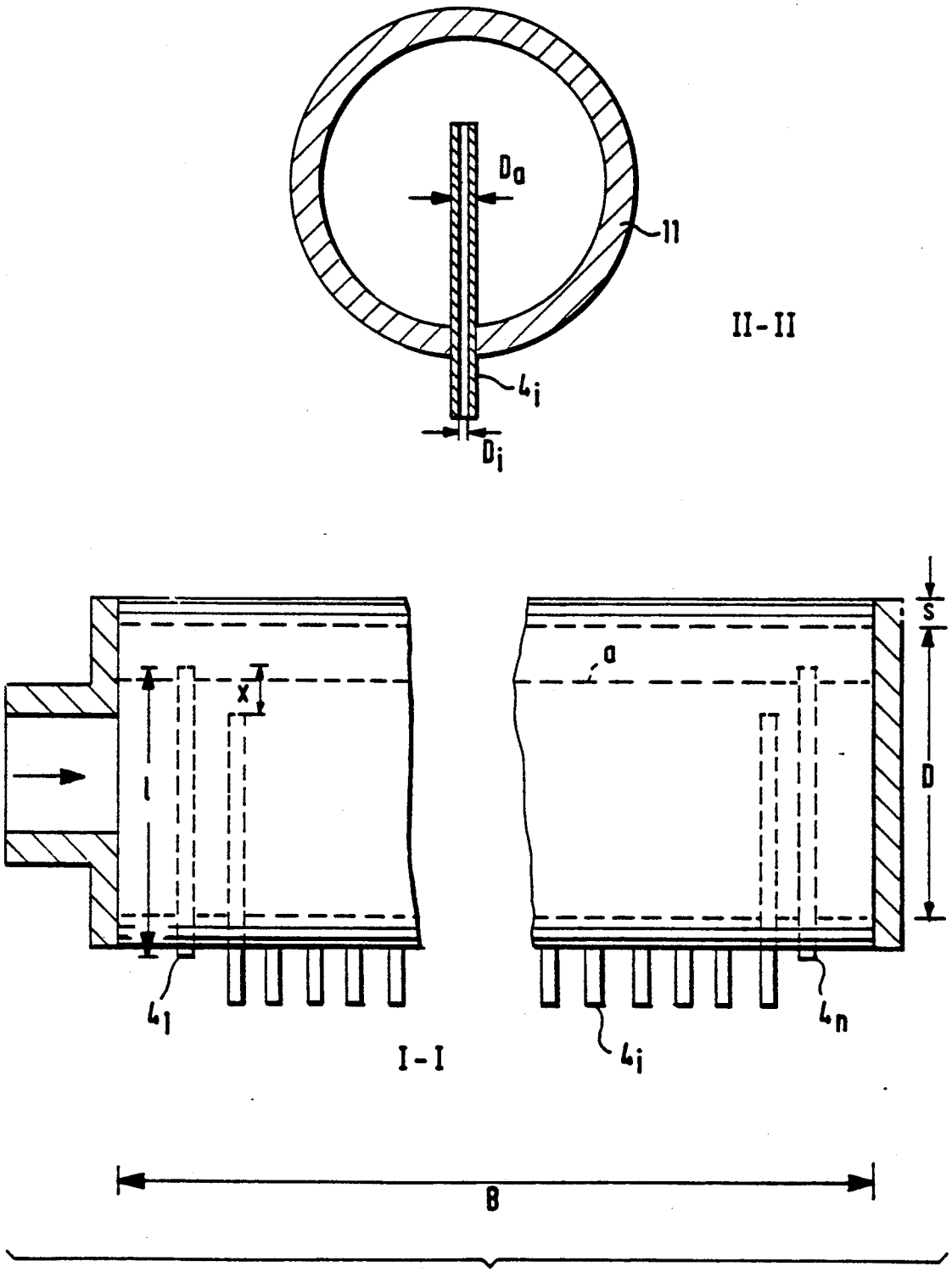
FIG. 3 shows sectional views along the lines I—I and II—II of the first embodiment according to FIG. 2.

FIG. 3 shows, in axial section I—I of FIG. 2, a preferred arrangement of the capillary tubes. In this embodiment, the two capillary tubes $4_l$ and $4_n$ located at the outside ends of the tubular distributor 2 protrude by a distance x of between about 6 and 12 mm further into the interior of the distributor than the other capillary tubes, so that automatic venting of the multi-jet nozzle 1 is obtained at these points, since the upper orifices of the two capillary tubes $4_l$ and $4_n$ protrude from a liquid level a' established in the distributor 2.

The section II—II shows the detailed arrangement of the capillary tubes in the circumferential surface 11 of the distributor 2, for example by means of snap-fitting.

The distance y of the outflow orifices of the two outer individual flow channels $4_l$ and $4_n$ from the web of material in the form of a carrier strip 5 is, for example, about 9 to 17 mm, whereas the distance y from the carrier strip 5 to the outflow orifices of the other individual flow channels of substantially equal length is only about 3 to 5 mm.

The pitch t of the individual flow channels $4_i$ is from about 1.5 to 7 mm, preferably about 5 to 7 mm.

Figure 4:
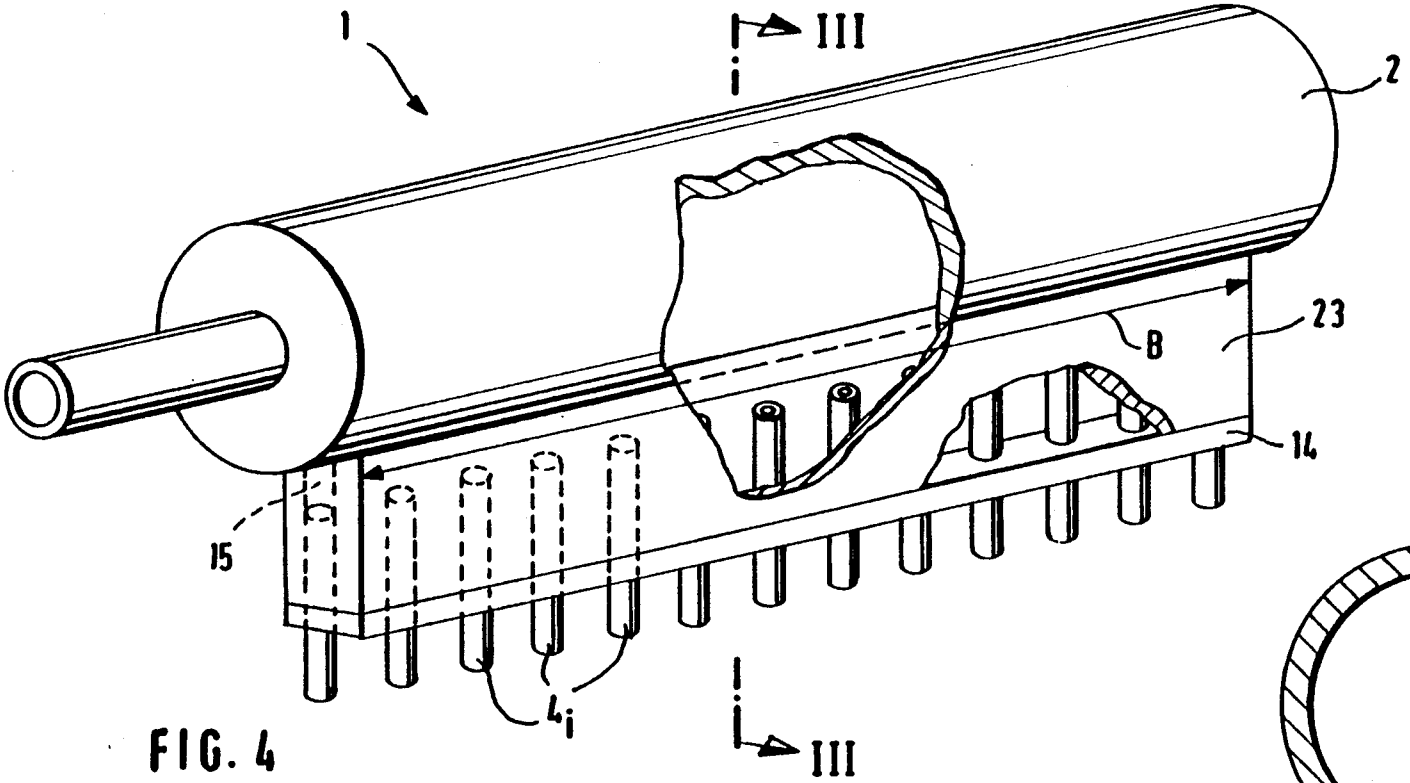
FIG. 4 shows a perspective view of a second, partially cut-away embodiment of a multi-jet nozzle with a slot die and capillary tubes inserted therein.

FIG. 4 shows a perspective view of a partially cutaway second embodiment of the multi-jet nozzle 1 according to the present invention, having a slot die 23 and individual flow channels $4_i$ in the form of capillary tubes, inserted therein, the index i meaning any particular capillary tube between 1 and the total number n. The capillary tubes of this embodiment are sealed at the underside of the slot die 23 by a perforated outflow strip 14 against an elongated rectangular channel 15 of the slot die 23.

The slot die 23 has a cubic shape and extends on the underside of the tubular distributor 2 over the width B.

Figure 5:
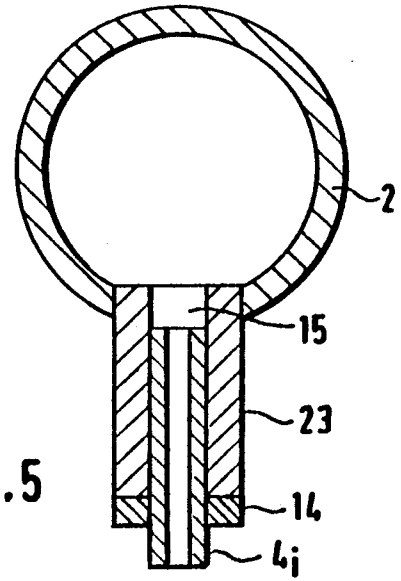
FIG. 5 shows a sectional view along the line III—III of the second embodiment according to FIG. 4.

FIG. 5 shows a section III—III transversely to the axis of the multi-jet nozzle in FIG. 4. The capillary tubes project from the underside of the outflow strip 14 and extend in the channel 15 of the slot die 23 to within about 6 to 8 mm of the connection orifice of the distributor 2.

In place of the capillary tubes inserted into the slot die 23, one slot half of the slot die can be provided on one side with flow channels in such a way that grooves or flutes are milled in at a defined pitch t and the other slot half can be provided with a smooth boundary surface. A channel system of individual flow channels is formed upon assembly of the two slot halves, without an additional gap. This design is shown in the drawing in FIG. 10.

The individual flow channels $4_i$ project in the manner of a comb from the outflow strip 14. If the distance of the outflow orifices of the individual flow channels $4_i$ from the carrier strip (not shown) is kept small, for example of the order of magnitude of about 1 to 5 mm, the emerging individual fluid streams should preferably have a laminar flow pattern. In place of the capillary tubes, perforations can be made in the outflow strip 14, in which case the outflow strip 14 must then have a corresponding wall thickness. In such an embodiment, turbulent flow conditions arise preferentially in the individual fluid streams, and these are applied in the case of relatively large distances between the outflow orifice of the individual flow channels and the carrier strip.

Figure 6:
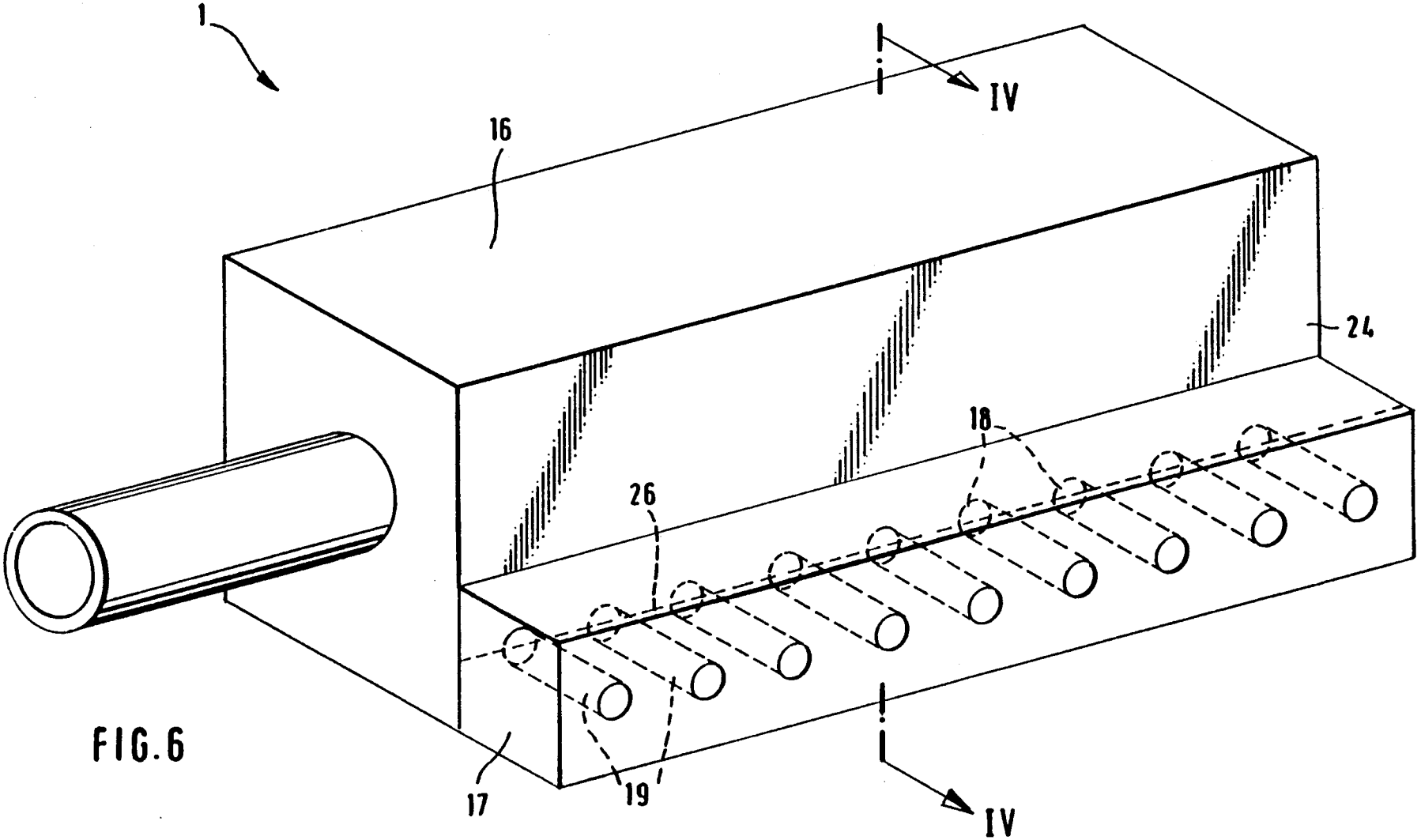
FIG. 6 shows a perspective view of a third embodiment of the multi-jet nozzle with a cubic distributor and a perforated outflow body arranged parallel to the distributor axis and laterally to the distributor.

FIG. 6 shows a perspective view of a third embodiment of the present invention wherein the multi-jet nozzle 1 includes a hollow, cubic distributor 16, whose side wall 24 contains wall bores 18 along a longitudinal line 26. A square-shaped outflow body 17 of solid material is attached to the side wall 24 and includes perforations or individual flow channels 19 which are flush with the wall bores 18. The wall bores 18 together with the individual flow channels 19 of the outflow body form the flow channels for broad constant metering of the liquid. In this case, the arrangement of the outflow tubes can also be aligned parallel to the running direction of the carrier material, so that the outflow jets or streams strike the web of material in the form of a parabola.

Figure 7:
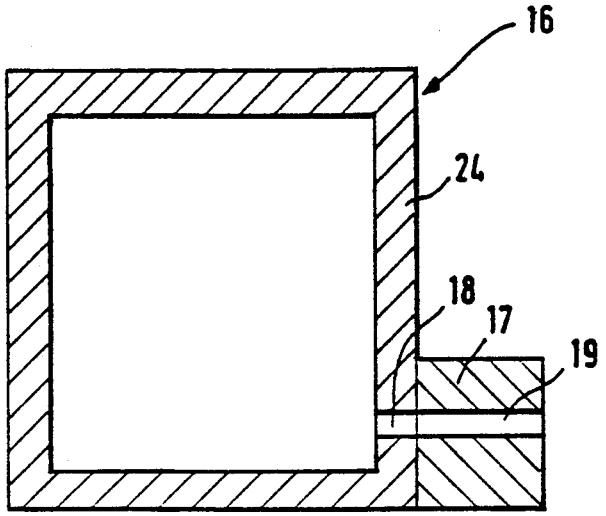
FIG. 7 shows a sectional view along the line IV—IV in FIG. 6 of the third embodiment.

FIG. 7 shows the section along the line IV—IV in the third embodiment and clearly shows that the distributor is cubic and hollow, while the outflow body consists of solid material in which the individual flow channels 19 are arranged flush with the wall bores 18 in the side wall 24 of the distributor 16.

Figure 8:
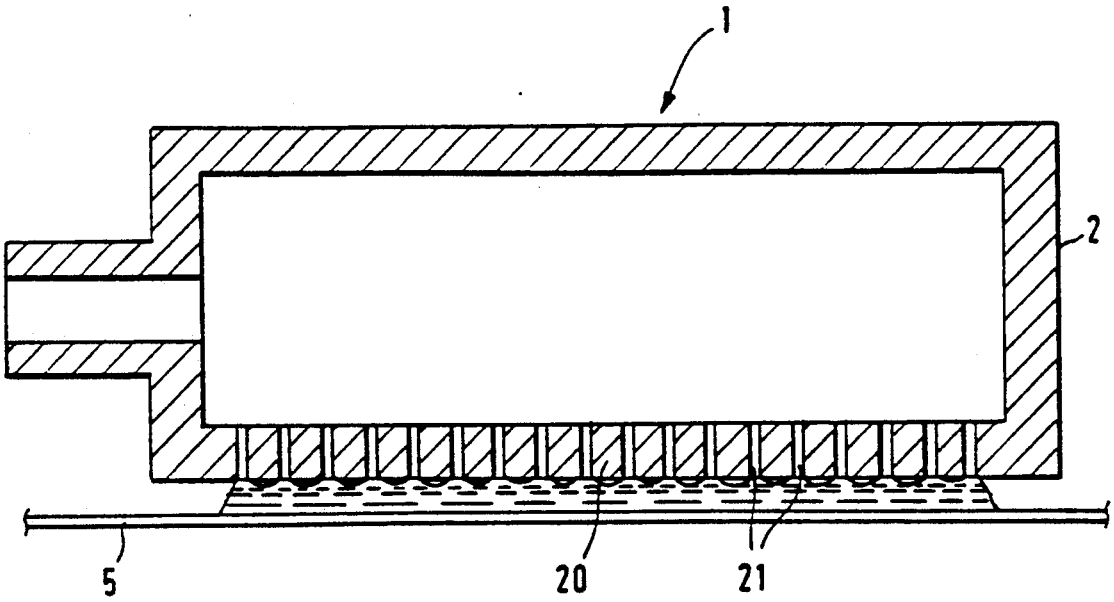
FIG. 8 shows a longitudinal sectional view of a fourth embodiment of a multi-jet nozzle, with a row of holes along a longitudinal line of the distributor.

A fourth embodiment of the multi-jet nozzle 1 according to the present invention is shown in section in FIG. 8. This embodiment consists of a tubular distributor 2, in whose outer surface 20 individual flow channels 21, which are formed, for example, as a row of holes of mutually parallel bores, are present along the longitudinal line. This embodiment is preferably used for homogeneous coatings at very small distances between the multi-jet nozzle 1 and the moving web 5 of material. In this case, liquid jets flowing out of the individual flow channels 2 immediately form coherent liquid bridges in the wetting gap and a closed film curtain as is indicated in FIG. 8. The closed film curtain leads to a uniform, coherent film coating on the carrier strip 5.

Figure 9:
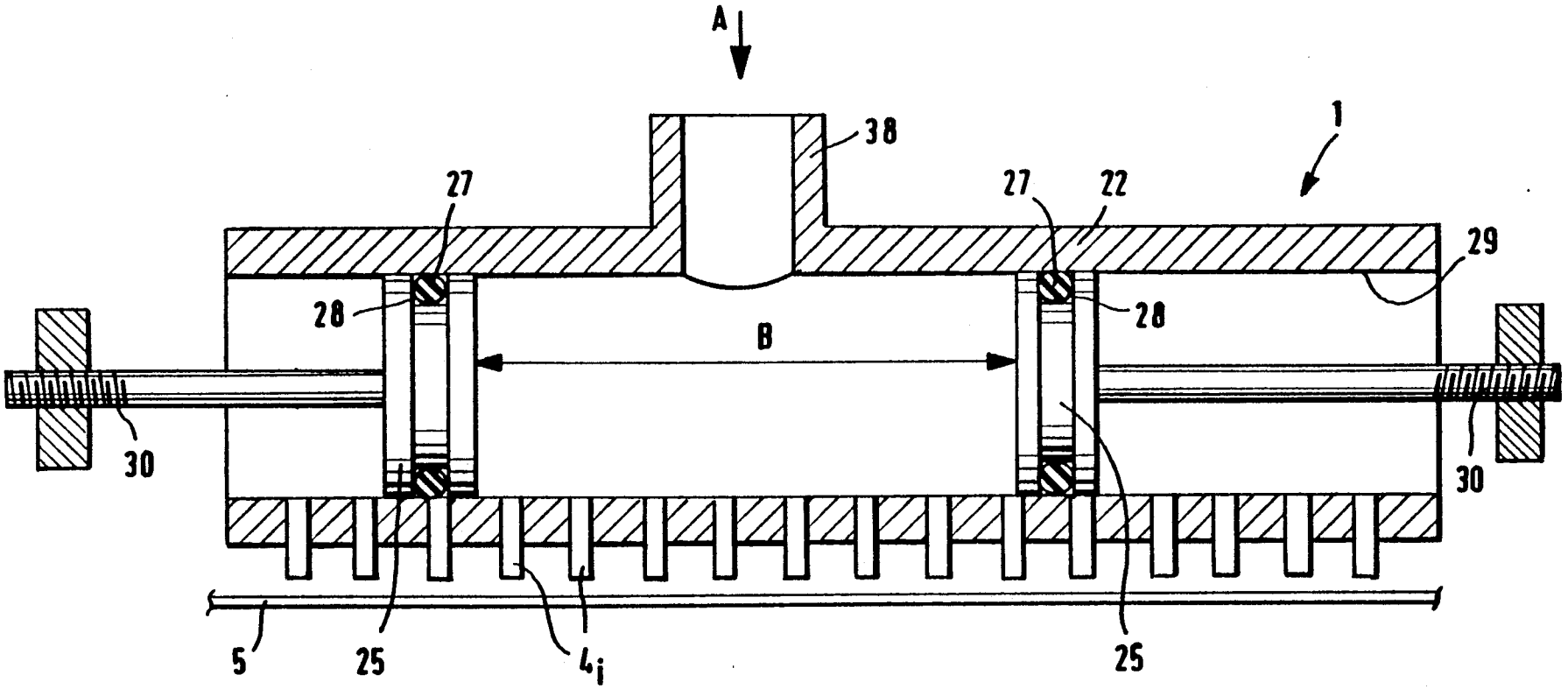
FIG. 9 shows a longitudinal sectional view of a fifth embodiment of a multi-jet nozzle with adjustable coating widths of the multi-jet nozzle.

FIG. 9 shows, in longitudinal section, a fifth embodiment of the present invention wherein the multi-jet nozzle 1 has a continuously adjustable coating or rinsing width B. In this embodiment, the liquid flows into the middle of a tubular distributor 22 via an inlet branch 38 into the distributor chamber, through individual flow channels $4_i$, which are provided in the form of capillary tubes located opposite the inlet branch, and onto the carrier strip 5 which is to be treated. The distributor 22 is designed, for example, as a circular-symmetrical tube with a honed and tempered inner wall 29 and is closed on both sides by displaceable pistons 25, 25 which carry sealing rings 27 in circumferential grooves 28. The annular grooves 28 are located adjacent the inner wall 29, against which the sealing rings 27, for example O-rings, bear.

The pistons 25 are laterally displaceable by means of spindles 30. Any desired coating width B on the carrier strip 5 can be set by positioning of the pistons 25. The capillary tubes end flush with the inner wall 29 of the distributor 22 and project on the outside of the distributor wall.

Figure 10:
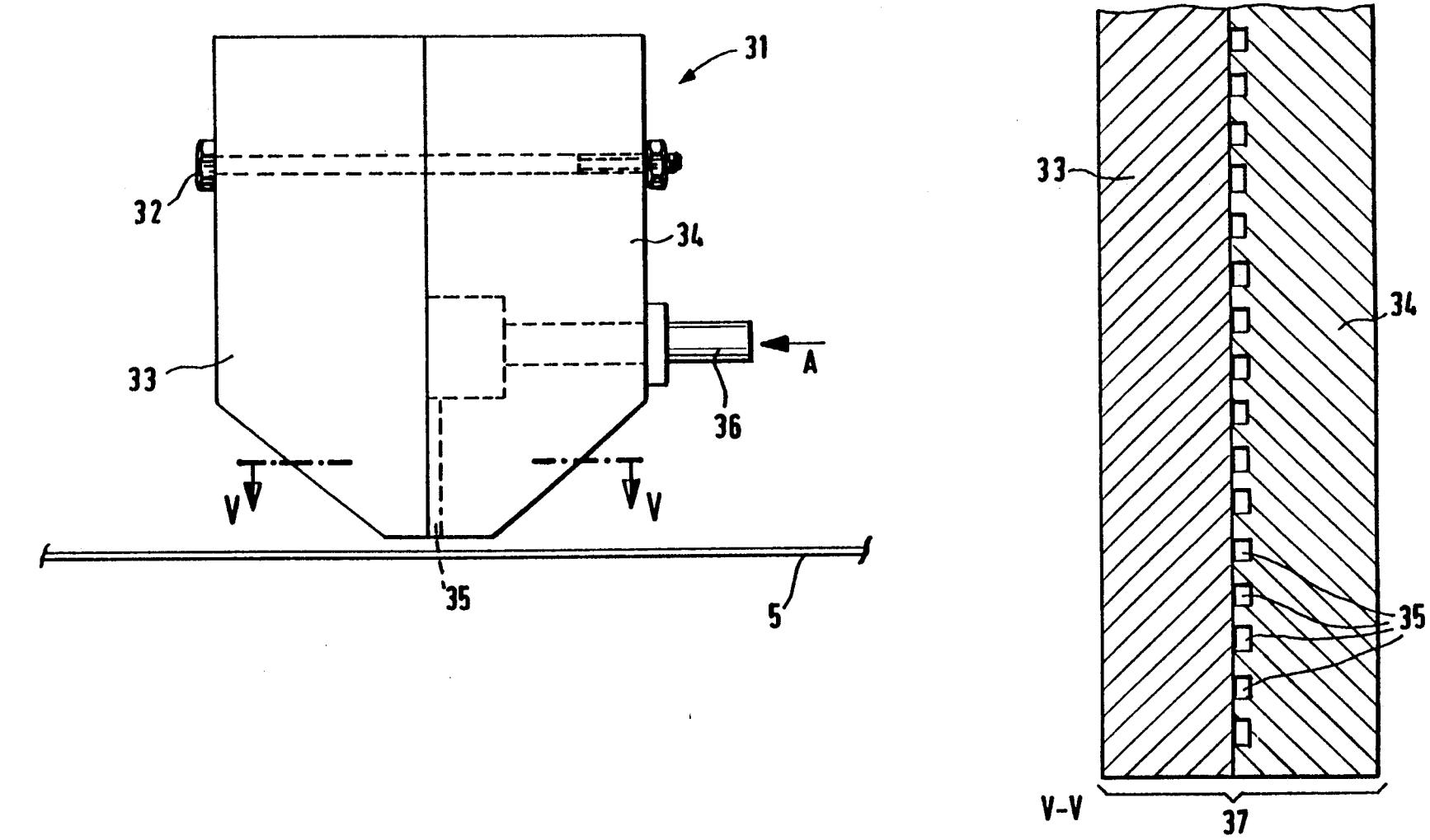
FIG. 10 shows a view and a section of a sixth embodiment of a multi-jet nozzle divided into two with a slot half grooved on one side.

FIG. 10 shows a view of a sixth embodiment according to the present invention which includes a multi-jet nozzle 31 which consists of a two-part distributor 37. The two halves 33, 34 of the distributor of the multi-jet nozzle 31 are held together without a gap by a screwed joint 32. The liquid flows through an inlet branch 36 in the direction of the arrow A into the interior of the multi-jet nozzle 31. It can be seen from the section V—V in FIG. 10 that one half 33 has a smooth boundary surface, whereas the other half 34 possesses a boundary surface provided with fluted grooves which form a multiplicity of individual flow channels 35 for the outlet of the liquid from the multi-jet nozzle 31 onto the carrier strip 5. The inlet branch 36 is fitted at a right angle to the distributor axis and laterally to the grooved half 34.

What is claimed is:

1. An apparatus for applying a fluid under hydrostatic pressure for uniform wetting or rinsing to a moving web of material, comprising a distributor for said fluid positioned above said moving web and a plurality of individual flow channels contiguous to said distributor, wherein said individual flow channels are arranged at right angles to the distributor axis at equal distances along a longitudinal line parallel to the distributor axis; each of said individual flow channels comprising one of bore or a capillary tube, said capillary tube having an internal diameter of greater than 0.3 to about 3.0 mm, an external diameter D of about 1.0 to 5.0 mm, and an outflow orifice; wherein said outflow orifices are located at a distance of about 3 to 5 mm from said moving web of material, and wherein a frictional pressure drop in the fluid flow across said distributor is smaller than a frictional pressure drop across said individual flow channels.

2. An apparatus according to claim 1, wherein said capillary tubes are inserted into second bores formed in a wall of said distributor along said longitudinal line.

3. An apparatus according to claim 1, wherein said distributor has an internal chamber with an internal diameter D and said capillary tubes protrude into said internal chamber of said distributor a distance greater than D/2.

4. An apparatus according to claim 3, wherein outer tubes of said capillary tubes located at each end of said longitudinal line protrude into said internal chamber by a distance of about 6 to 12 mm further than capillary tubes located between said outer tubes.

5. An apparatus according to claim 4, wherein the outflow orifices of said outer capillary tubes are located about 9 to 17 mm above said moving web of material.

6. An apparatus according to claim 1, wherein said individual flow channels are separated by an equal distance ranging between about 1.5 and 7 mm.

7. An apparatus according to claim 1, wherein said distributor is tubular-shaped.

8. An apparatus according to claim 1, further comprising a slot die which is connected to said distributor via an elongated rectangular channel, and wherein said individual flow channels comprises capillary tubes projected into said elongated rectangular channel through a perforated outflow strip which seals an underside of said slot die.

9. An apparatus according to claim 8, wherein said capillary tubes project, in the manner of a comb, from the outflow strip in the direction of said moving web of material.

10. An apparatus according to claim 9, wherein said capillary tubes each include an upper inlet orifice which is located at a distance of about 6 to 8 mm underneath said distributor and bears flush against an inner wall of said elongated rectangular channel.

11. An apparatus according to claim 1, wherein said distributor has a rectangular cross-section and includes an internal chamber.

12. An apparatus according to claim 11, further comprising an outflow body of solid material adjoining a side wall of said distributor, said outflow body having a square-shaped cross-section and wherein said individual flow channels comprise mutually parallel perforations formed in said outflow body, said side wall having a plurality of wall bores flush with said individual flow channels.

13. An apparatus according to claim 12, wherein said wall bores are arranged along said longitudinal line.

14. An apparatus according to claim 7, wherein said individual flow channels comprise a plurality of parallel bores formed in the wall of said tubular distributor and arranged along said longitudinal line.

15. An apparatus according to claim 7, further comprising a pair of mobile pistons as the end faces of said tubular distributor and means for adjusting laterally the positions of said pistons within said tubular distributor, wherein the pistons each carry, in a circumferential annular groove, a sealing ring which is in sealing contact with the inner wall of said tubular distributor.

16. An apparatus according to claim 15, wherein said adjusting means comprises a spindle.

17. An apparatus according to claim 15, further comprising an inlet branch which communicates with said tubular distributor at a position approximately one-half the length of said tubular distributor.

18. An apparatus according to claim 17, wherein said individual flow channels comprise capillary tubes which penetrate the wall of said tubular distributor opposite said inlet branch, said capillary tubes having inlet ends and outlet ends.

19. An apparatus according to claim 18, wherein said inlet ends of said capillary tubes are flush with the inside wall surface of said tubular distributor and said outlet ends of said capillary tubes project a distance beyond the outside wall surface of said tubular distributor.

20. An apparatus according to claim 1, wherein said distributor comprises a first half which has a smooth boundary surface, a second half which has a boundary surface provided with fluted grooves which form said individual flow channels, and means for joining together said first and second halves.

21. An apparatus according to claim 20, further comprising an inlet branch which communicates with said second half of said distributor, wherein said inlet branch is joined at a right angle to the distributor axis and laterally to said second half.

* * * * *